United States Patent [19]

Greer

[11] 4,406,415

[45] Sep. 27, 1983

[54] ROTOR ASSEMBLY FOR HAMMERMILLS

[76] Inventor: Jack B. Greer, Box 247, Siler City, N.C. 27344

[21] Appl. No.: 280,561

[22] Filed: Jul. 6, 1981

[51] Int. Cl.[3] ..... B02C 13/04; B02C 13/20

[52] U.S. Cl. ..... 241/194; 241/197

[58] Field of Search ..... 241/189 R, 189 A, 194, 241/197

[56] References Cited

U.S. PATENT DOCUMENTS

| | | | |
|---|---|---|---|
| 2,170,407 | 8/1939 | Hartshorn | 241/189 A |
| 3,367,585 | 2/1968 | Ratkowski . | |
| 3,482,788 | 12/1969 | Newell . | |
| 3,650,484 | 3/1972 | Kimble et al. | 241/197 |
| 3,727,848 | 4/1973 | Francis | 241/194 |
| 4,056,232 | 11/1977 | Linnerz et al. | 241/194 |
| 4,222,530 | 9/1980 | Whitney | 241/194 |
| 4,313,575 | 2/1982 | Stepanek | 241/197 X |

*Primary Examiner*—Mark Rosenbaum
*Assistant Examiner*—Timothy V. Eley
*Attorney, Agent, or Firm*—Charles R. Rhodes; Judith G. Smith

[57] ABSTRACT

A hammermill in which the hammers are carried by suspension rods for free swinging movement between a plurality of spaced discs. Each disc is provided with a peripheral hole pattern which includes a greater number of holes than there are hammers carried between each adjacent pair of discs thereby providing for relocation of the hammers one or more times to extend the life of the discs. Further protective shoes or caps cover the peripheral edge and a portion of the machined side surfaces of each disc which are subjected to extreme wear.

5 Claims, 4 Drawing Figures

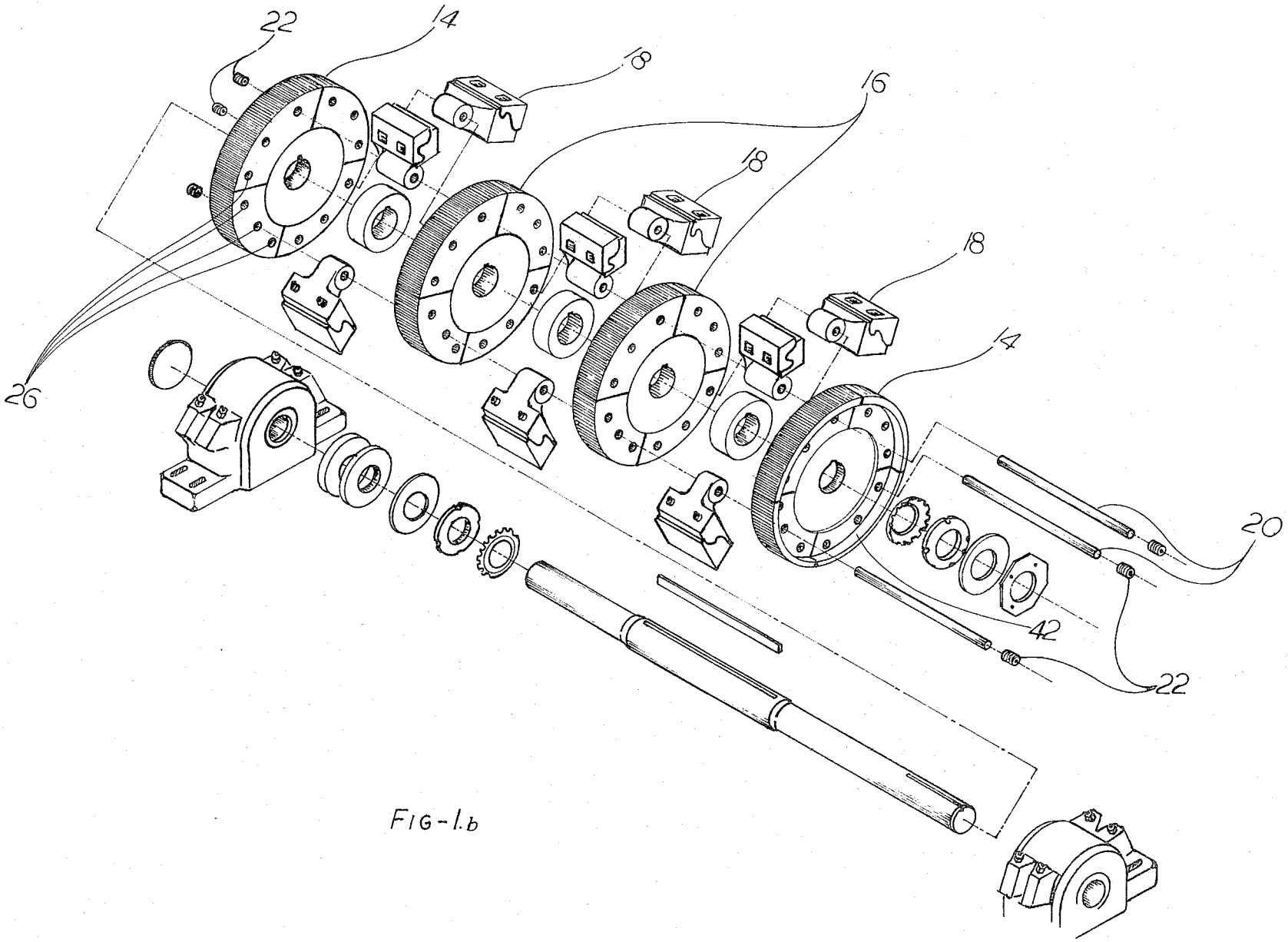
FIG-1.b

ROTOR ASSEMBLY FOR HAMMERMILLS

BACKGROUND AND SUMMARY OF THE INVENTION

Grinders or hammermills of the type widely used for grinding clay and shale in industries such as brick making generally include a housing and a rotary hammer assembly. The hammer assembly includes a plurality of rotatable discs or spiders between which the hammers are mounted by means of suspension pins. The hammers are mounted such that the clay or shale material is crushed between them as the hammer assemblies rotate.

As stated, the hammers are mounted for free swinging movement on the rotor discs or spiders by means of suspension pins which extend through aligned holes in either the disc or the spider and the hammer shank. The hammers are mounted between the discs at close tolerances just sufficient for clearance. There is approximately ⅛ inch tolerance between the side walls of the hammer shank or arm and the sidewalls of adjacent rotor discs.

Because of the constant swinging movement of spider or the hammers on the suspension pins, and because of the constant cloud or fog of abrasive dust created by the clay and shale, the adjacent side surfaces of the rotor discs and spiders are subject to extreme wear from the hammer shank, or the constant wear of metal against metal.

Various approaches to protecting the rotor disc from other types of wear are illustrated in a variety of patents. One approach which is of particular interest is shown in U.S. Pat. No. 4,222,530 to Whitney. That approach utilizes a replaceable cap of wear resistant metal on the end discs of a rotor shredder which do not have a swinging hammer shank adjacent thereto. The shredder disclosed therein is of a design utilizing a spider arm hammer assembly. It is important to note that the only rotor discs thereon are the end discs adjacent the housing walls. The side walls of the spiders, between which are carried the hammers, are left unprotected. Only the exposed edge of the spider arms are covered with a protective cover. The replaceable caps used on the end discs as disclosed by Whitney include a U-shaped channel which receives a curved portion of the periphery of the end disc therein. When the cap is in position on the disc, holes in the sidewalls of the cap are aligned with specially drilled holes in the end disc, and mounting pins are inserted therethrough and secured in place by welding a washer thereon. The cap is thus retained in place on the end disc by the welded pin and washer. When it is necessary to replace one of the caps, each of the welded pins must be broken and removed. The cap is then replaced and new pins welded into place. The procedure is thus expensive in that it is time consuming and requires considerable investment in parts, tools and labor.

Applicant's device was designed to improve the life of the end and interior discs and to overcome many disadvantages of the prior art devices. The present invention is particularly adapted for shredders of the type having a plurality of end and inside discs with hammers mounted therebetween.

At the outset the discs (inner and outer) are provided with a unique peripheral hole pattern in which there is a plurality of holes exceeding in number the number of hammers carried between each adjacent pair of discs. The holes are aligned and suspension pins or rods inserted through each aligned set of holes. Some, but not all, of the suspension rods have hammers mounted for free swinging movement thereon. Preferably the number of holes in each disc is a common multiple of the different numbers of hammers likely to be carried by various hammermills. For example, most hammermills carry either 3, 4, or 6 hammers between each set of discs. Therefore twelve (12) equally spaced holes are generally provided in the hole pattern, and if a hammermill has 3 hammers between each adjacent pair of discs, they may be located in four different positions, thus extending the life of the discs (or protective cap) four times; similarly a four hammermill can be positioned three times and a six hammermill twice before the discs (or protective caps) are completely worn and must be replaced.

Further in the present invention a replacement cap or protective shoe provided which is of a U-shaped configuration and is made of a wear-resistant metal, but the similarities to the Whitney device end there. The replaceable cap of the present invention is easily mounted or removed because the caps are held in place by the suspension rods alone. Therefore they may be easily removed and replaced when required, and a plurality of which may be secured in position by the same suspension rods on which the hammers are rotatably mounted.

The replaceable, wear resistant caps can also be repositioned along the periphery of the rotor discs. Each of the U-shaped caps include a cap portion and opposing sidewalls, and a plurality of apertures in each sidewall, which apertures are aligned with adjacent ones of the aforementioned apertures in the rotor disc. The cap is placed over an arcuate portion of the periphery of the rotor disc with the sidewall of the cap overlying a portion of each surface of the disc. A suspension rod is then inserted through each of the sets of apertures to hold the caps in place. The suspension rods are of a length sufficient to extend through all the discs and hammers in the rotor assembly. Thus, when the caps or hammers need to be repositioned or replaced it is a simple operation to unfasten and remove the suspension rods, automatically freeing the caps and the hammers for removal. Obviously each of the suspension rods does not have a hammer suspended therefrom. However, each of the apertures in the protective cap must have a suspension rod extending therethrough to prevent the cap from rocking and wobbling on the disc. If, as is described hereinabove the rotor discs have twelve apertures spaced around the periphery, and protective caps cover the outer periphery of the disc, then twelve suspension rods are required to secure the caps. However, there will generally be only three, four or six hammers mounted between each adjacent pair of discs.

Therefore, the present invention is a hammermill having an improved rotor disc and replaceable protective disc cap, with the parts having a significantly increased life and wear resistance. The disc caps protect the outer periphery of the rotor discs and significant portions of the disc sidewalls from wear caused by the freely swinging hammers. Relocation of the hammers extends the life of the caps, because normal wear can be spread over a wider area. Further, the caps utilized on the end or outer rotor discs include a flange depending outwardly from the cap portion of the channel perpendicular to the outer sidewall, which flange protects the ends of the suspension rods and also keeps clay and shale from falling down between the outer discs and the hammermill housing.

The objects of the present invention thus include the provision of an improved replaceable, protective cap for the end and intermediate rotor discs of a hammermill, the replaceable cap being designed to protect the side surfaces and the outer edge of the rotor discs.

It is also an object of the present invention to provide a rotor assembly for a hammermill which is designed such that the hammers can be repositioned at various arcuate positions between adjacent rotor discs to evenly distribute the wear on the discs or disc caps.

A still further object of the invention is the provision of means for quickly and easily replacing or repositioning the hammers and protective caps with a minimum amount of machine downtime.

Still other and further objects of the invention will become apparent to those skilled in the art as the following detailed description is studied in conjunction with the attached drawings.

FIG. 1*a* is a perspective view of a typical hammermill, with the housing or cover cut away, and illustrating a pair of rotor assemblies supporting a plurality of opposed hammers in a conventional manner.

FIG. 1*b* is an exploded perspective view of a hammermill rotor assembly according to a preferred embodiment of the present invention.

DETAILED DESCRIPTION OF A PREFERRED EMBODIMENT

Figure 1A:
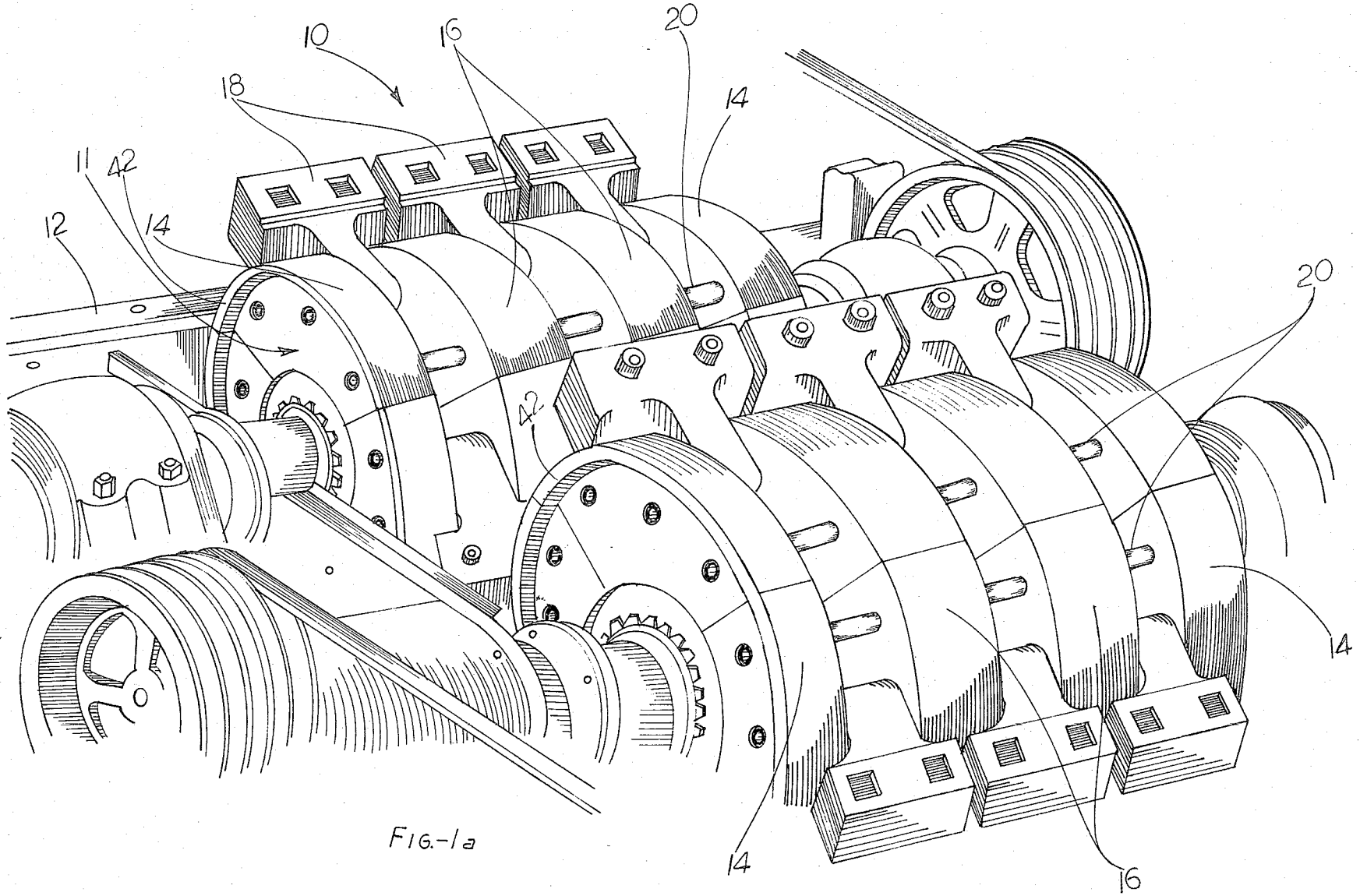

Looking first at FIG. 1*a* the numeral 10 denotes the interior of a hammermill housing having a pair of rotor assemblies 11 mounted therein. Hammermills of this type are designed for grinding clay and shale in preparation for making brick and other ceramic products. Detailed discussion of the overall operation is not included herein because such assemblies are well known in the art and are not the focus of the present application.

The rotor assemblies 11 in a working environment are enclosed in a housing, a portion of which is shown at 12. Clay or shale is fed from a hopper above (not shown) into the interface between the rotor assemblies 11 where it is ground to a powder state by and between the rotating hammers. Each assembly 11 includes a plurality of rotor discs of two types: end or outside discs 14; and inner or intermediate discs 16 that will be more fully described below. In FIG. 1*a* there are four rotor discs and three rows of hammers 18 in each assembly. The hammers 18 are mounted for free swinging movement between the adjacent pairs of rotating discs 14,16 by means of suspension rods 20 which are best illustrated in FIG. 1*b*. As illustrated the rods 20 are of a length sufficient to extend continuously through all the rotors and hammers, and are held in place by bolts 22 on each end of the rod.

In a conventional hammermill of the type shown there may be three, four or six hammers between each pair of discs, although the one shown has three hammers 18 mounted between each pair of discs 14,16. Because of the constant rotation of the discs and swinging movement of the hammers and the close tolerances therebetween, there is a constant rubbing of metal against metal (sometimes with pieces of rock therebetween), resulting in wearing away of the sidewalls of the discs 14,16 in the vicinity of the point where the suspension rods pass therethrough. The present inventor has alleviated much of this problem by developing an improved rotor disc and a removable protective cap therefor.

The rotor discs 14,16 without the protective caps, are best illustrated in FIG. 1*a*. There are two end or outside discs 14 and two inside discs 16 in each set of the illustrated assembly in FIG. 1*a*. Each of the discs include a plurality of apertures 24 around the periphery, through the central portion or sidewalls 26 thereof. In the embodiment shown there are twelve apertures 24. In larger hammermills there may be an increased number of apertures but preferably in multiples of the least common multiple of the numbers of hammers to be used on the hammermills by a broad range of users. This plurality of apertures permits relocation of the hammers to a plurality of positions around the discs such that the wear on the discs may be evenly distributed. For example, in the embodiment shown there are three hammers 18 per pair of discs 14,16. The hammers are mounted at equally spaced points around the discs. With prior art discs there is no means for repositioning the hammers because there would have been only three apertures, one per hammer. With applicant's device the three hammers can be positioned four times. Two hammers would have six possible positions, etc. Therefore, as wear becomes objectionable at one position on the walls of the discs 14,16, the hammers are moved to a position that is not worn.

Figure 2:
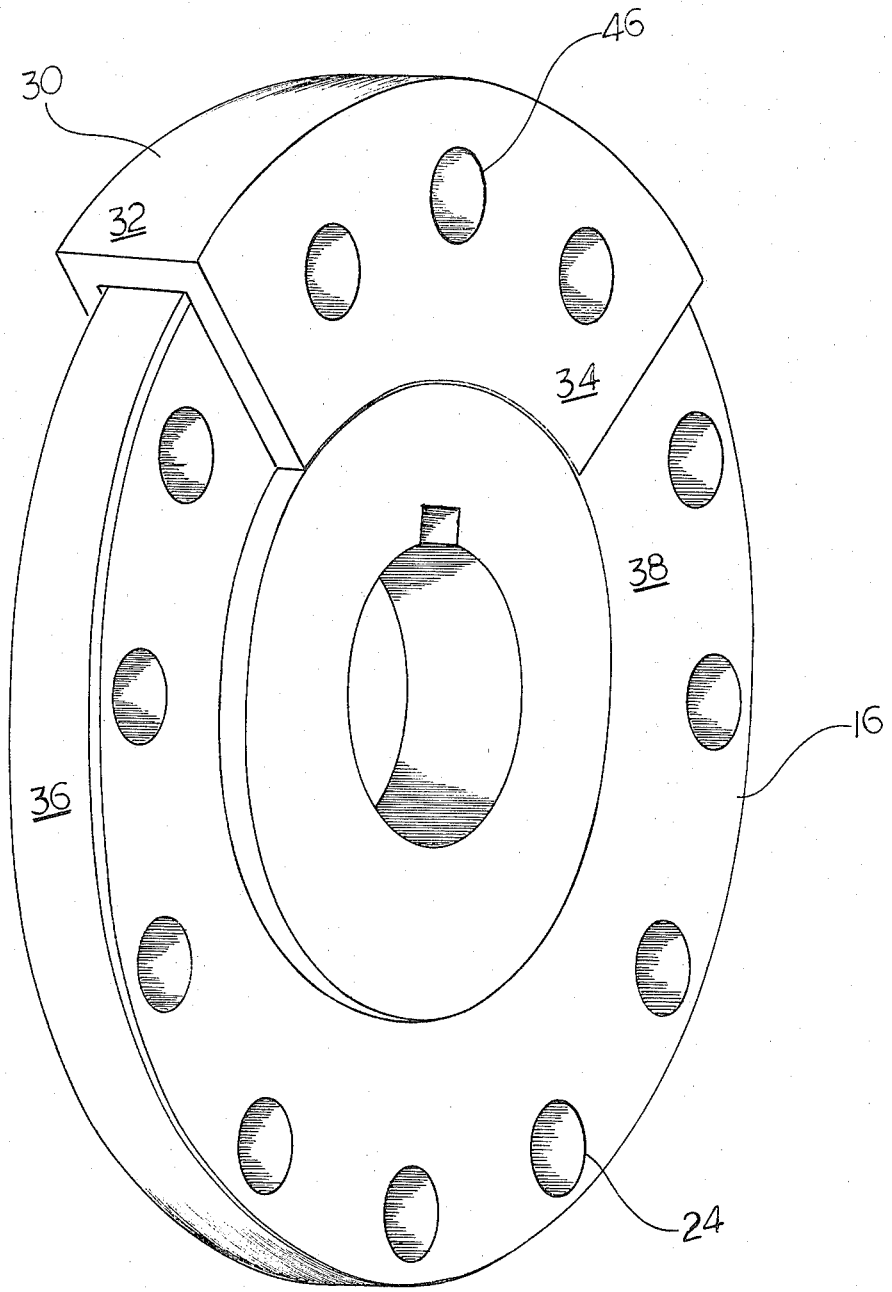
FIG. 2 is a perspective view of an inside rotor disc and protective cap mounted thereon.
Figure 3:
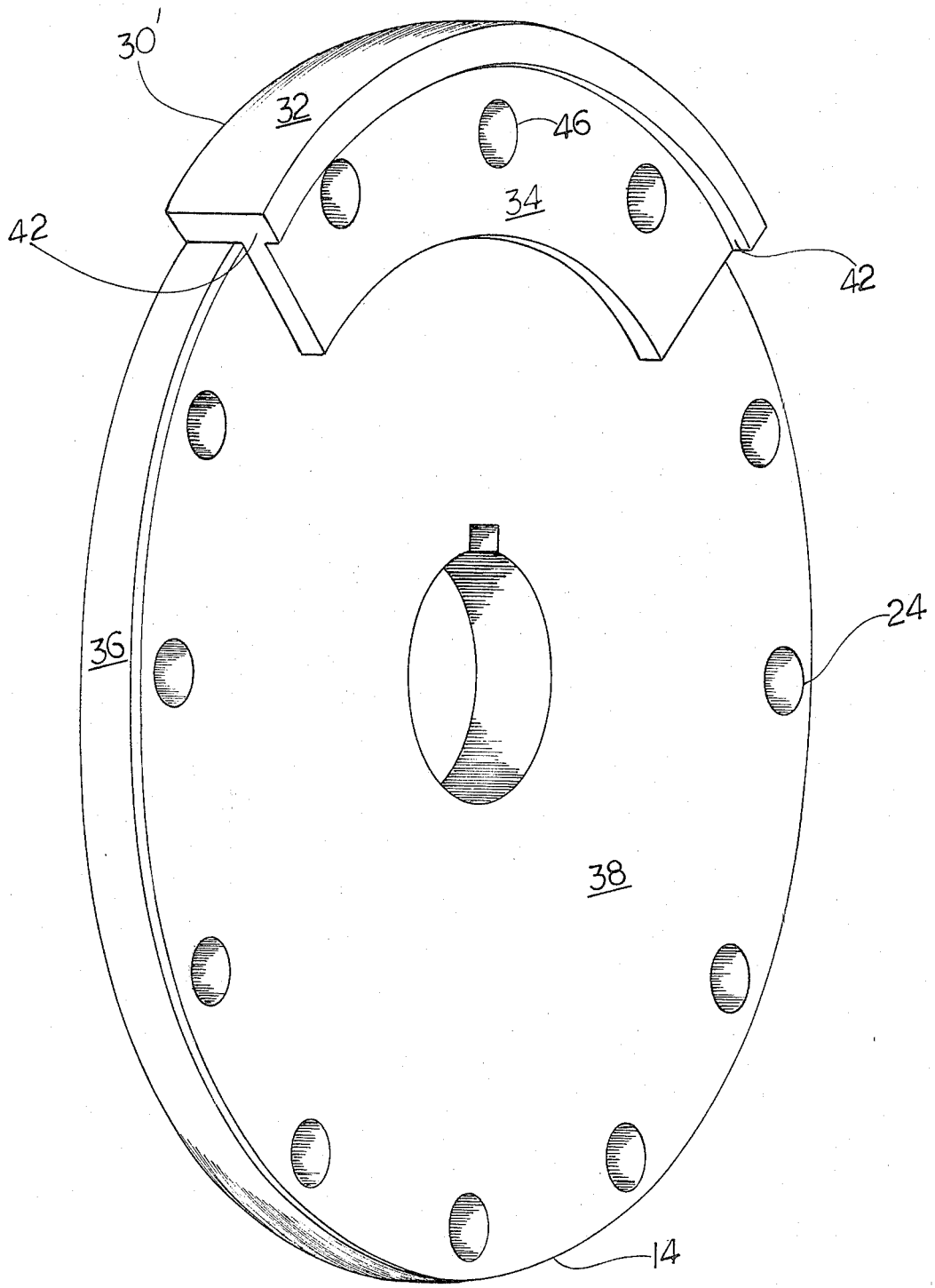
FIG. 3 is a perspective view of an end rotor disc and protective cap mounted thereon.

To further increase the life of the rotor discs applicant has developed an improved, replaceable protective cap for the rotor discs. FIGS. 2 and 3 illustrate an inside disc 16 and an end or outside disc 14, respectively, with the protective cap 30 mounted on an arcuate portion of the disc.

The protective cap is of a substantially U-shaped configuration having a cap portion 32 and a pair of opposing sidewalls 34 depending perpendicularly from the cap. The cap portion 32 overlies the outer periphery or edge 36 of the disc 14 or 16, and the sidewalls 34 overlie a portion of the center or sidewall 38 of the disc. An area 40 adjacent the periphery or outer edge 36 of the discs is of reduced thickness so that when the protective cap 30 is mounted in place the surface of the sidewall 34 is flush with the wall 38 of the disc, thus providing a smooth surface.

The protective cap 30' (FIG. 3) designed for utilization on the end discs 14 include an additional element in the form of a flange 42 depending outwardly from the outer side of the cap portion 32 perpendicular to the sidewalls 34. This flange 42 extends beyond the outer wall of the end discs 14 between the disc and the wall of the hammermill housing. Thus positioned the flange aids in preventing the clay and shale from falling down into the housing and collecting in the bottom. There is approximately a two-inch clearance between the outer surfaces of the end discs 14 and the housing walls and the flange 42 spans substantially that entire distance. It should also be noted that the caps 30' for the end discs are flush with only the inner wall of the rotor disc. The outside wall of the rotor disc is not cut away. In some instances the outer side wall of the protective cap 30' may be omitted completely as that surface of the disc is not subjected to wear.

Each sidewall 34 of the protective cap 30 includes a plurality of spaced apertures or bores 46 through the surfaces thereof for attaching the cap to the rotor discs.

The bores 46 in one sidewall 34 are aligned with the bores 46 in the opposed sidewall, and when the cap 30 is mounted on the disc the bores 46 are aligned with the selected apertures 24 on the disc. Once all caps 30 are positioned on all discs, a suspension rod 20 is inserted through all the aligned discs, caps and hammers and it is bolted together in secure engagement. As previously stated some of the suspension rods 20 will have hammers 18 mounted thereon and some will not. However, there should be a suspension rod through every bore 46 of the protective cap 30 so the cap will not rock or wobble on the disc.

While a preferred embodiment of the improved hammermill assembly has been shown and described, it will be understood by those skilled in the art that further changes and modifications could be made without departing from the scope of the claims below.

What is claimed is:

1. In a hammermill of the type for grinding clay and shale wherein a plurality of circular rotor discs are mounted in spaced arrangement on a common drive shaft, and hammers are swingably mounted between adjacent discs on suspension pins extending through a plurality of said rotor discs, the improvement comprising:

(a) a plurality of protective shoes for protecting the side surface of said circular rotor discs from wear as a result of the swinging movement of said hammers, each of said shoes being formed from a wear-resistant material and having a generally arcuate, U-shaped channel for receiving a portion of the periphery of one of said rotor discs;

(b) said arcuate, U-shaped channel having a cap portion and a pair of opposed sidewalls, each of said sidewalls having a plurality of apertures extending therethrough, the apertures in each sidewall being aligned with respective apertures in the opposed sidewall;

(c) said suspension pins being of a length sufficient to extend through said apertures on all of said rotor discs, through protective shoes and hammers, and including means for releasably securing said pins therethrough;

(d) said plurality of rotor discs comprising a plurality of inside rotor discs positioned between a pair of opposed end discs, said inside discs having a portion of each sidewall machined out, and each end disc having a portion of the interior wall thereof machined out to receive said protective shoes such that the outer surface of the side walls of said shoe forms a continuous plane with the corresponding wall of each of said discs;

(e) said plurality of protective shoes including at least a pair of said shoes being designed for use on said end discs; said shoes for said end discs having a flange depending outwardly from said cap portion in a direction perpendicular to said side walls and away from said inside discs;

whereby said protective shoes are positioned around the entire periphery of said discs to protect the surfaces thereof from hammer and grinding material wear.

2. The improvement according to claim 1 wherein said circular rotor discs include a plurality of apertures in spaced relationship around the periphery thereof with said plurality of apertures being greater in number than the number of hammers mounted between adjacent discs, whereby said hammers can be located in different combinations around said rotor discs.

3. In a hammermill according to claim 1 wherein the hammers are swingably mounted between adjacent discs on suspension pins which extend through a plurality of said rotor discs, the improvement comprising each of said rotor discs having a plurality of apertures therethrough positioned around the periphery of said rotor disc, the number of said apertures being greater by a multiple of at least two than the number of hammers mounted between adjacent discs, whereby said hammers can be located in different positions around the periphery of said discs.

4. The improvement according to claim 3 wherein the number of apertures in each disc is 12.

5. The improvement according to claim 3 and further including:

means for removably securing said protective shoes to said rotor disc, said means comprising a suspension rod to be inserted through each of said apertures in said discs and said shoes, and a bolt means to retain said suspension rod in position.

* * * * *